US006250368B1

(12) United States Patent
Ushio et al.

(10) Patent No.: US 6,250,368 B1
(45) Date of Patent: Jun. 26, 2001

(54) CASTING MOLD FOR PRODUCING A FIBER-REINFORCED COMPOSITE ARTICLE BY DIE-CASTING PROCESS

(75) Inventors: Hideaki Ushio; Kazuo Shibata; Kazuhisa Ishizuka, all of Wako (JP)

(73) Assignee: Honda Giken Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/290,263

(22) Filed: Apr. 13, 1999

Related U.S. Application Data

(63) Continuation-in-part of application No. 08/934,780, filed on Sep. 22, 1997, now abandoned.

(30) Foreign Application Priority Data

Sep. 25, 1996 (JP) ..... 8-252701

(51) Int. Cl.[7] ..... B22D 17/10; B22D 19/08

(52) U.S. Cl. ..... 164/312; 164/98; 164/133; 164/342

(58) Field of Search ..... 164/113, 312, 164/98, 332, 333, 342, 133

(56) References Cited

U.S. PATENT DOCUMENTS 4,727,923 3/1988 Ebisawa et al. ..... 164/113

FOREIGN PATENT DOCUMENTS 0 751 289 A1 1/1997 (EP) .
0 796 926 A1 9/1997 (EP) .
2 194 473 3/1988 (GB) .
58-196159 11/1983 (JP) .
2-84247 3/1990 (JP) .
4-339556 11/1992 (JP) .
8-197229 8/1996 (JP) .
WO 92/15415 9/1992 (WO) .

OTHER PUBLICATIONS

Patent Abstracts of Japan, vol. 013, No. 045 (M–792), Feb. 2, 1989 & JP 63–252664A (Honda Motor Co., Ltd.) Oct. 19, 1988.

Patent Abstracts of Japan, vol. 013, No. 204 (M–825), May 15, 1989 & JP 01–027764A (Honda Motor Co., Ltd.) Jan. 30, 1989.

Patent Abstracts of Japan, vol. 013, No. 274 (M–841), Jun. 23, 1989 & JP 01–071567A (Honda Motor Co., Ltd.) Mar. 16, 1989.

Patent Abstracts of Japan, vol. 013, No. 083 (M–802), Feb. 27, 1989 & JP 63–281761A (Honda Motor Co., Ltd.) Nov. 18, 1988.

Patent Abstracts of Japan, vol. 016, No. 083 (M–1216), Feb. 28, 1992 & JP 03–268855A (Toyota Motor Corp.) Nov. 29, 1991.

*Primary Examiner*—Kuang Y. Lin
(74) *Attorney, Agent, or Firm*—Arent Fox Kintner Plotkin & Kahn

(57) ABSTRACT

A mold is provided which is capable of producing a sound fiber-reinforced composite article utilizing a die-casting process. A cavity in the mold includes a composite article forming area in which a formed product of fiber is located, a molten metal storing area located adjacent the composite article forming area to fill a molten metal into the formed product of fiber, and a molten metal flow slackening area for reducing the turbulent flow of the molten metal from gates to introduce it to the molten metal storing area. Thus, the flow of the molten metal introduced into the molten metal storing area, is brought into a substantially laminar flow state, so that the inclusion of air in the molten metal flow is inhibited. Therefore, the molten metal in the molten metal storing area can be smoothly filled into the formed product of fiber under pressure.

4 Claims, 6 Drawing Sheets

CASTING MOLD FOR PRODUCING A FIBER-REINFORCED COMPOSITE ARTICLE BY DIE-CASTING PROCESS

This application is a continuation-in-part of U.S. Ser. No. 08/934,780, filed Sep. 22, 1997, now abandoned, which is hereby incorporated by reference.

BACKGROUND OF THE INVENTION

1. Field of the Invention

The present invention relates to a casting mold for producing a fiber-reinforced composite article by a die-casting process, i.e., a mold used for a die casting process to produce a fiber-reinforced composite article comprised of a formed product of fiber and a metal matrix.

2. Description of the Prior Art

In a die casting process, the gate speed of molten metal flow is on the order of about 30 to 45 m/sec and hence, the molten metal flow is brought into a turbulent flow within the cavity of the mold. If such a molten metal flow collides against a formed product of fiber, there is a possibility that the formed product of fiber may be deformed or broken, and there is also a possibility that the filling of the molten metal into the formed product of fiber may be impeded by air included into the molten metal flow. In a member including a simple-metal portion integral with the fiber-reinforced article, the air included in the molten metal flow forms air bubbles in the outer surface of the formed product of fiber due to the filtering effect of the fiber formed-product which permits the passing of only the molten metal, and as a result, blow holes are produced in the simple-metal portion.

Accordingly, it is now conventional practice to carry out the casting at a low gate speed of molten metal flow, reduced, for example, to about 0.4 m/sec.

With the conventional process, however, an existing injection device cannot be used, and an exclusive injection device is required, resulting in the problem that the equipment cost is increased, and the efficiency of production of the fiber-reinforced composite article is degraded with the reduction in gate speed of the molten metal flow.

SUMMARY OF THE INVENTION

It is an object of the present invention to provide a mold of the above-described type, wherein even if the gate speed of the molten metal is increased to that used in a typical die-casting process, a sound fiber-reinforced composite article can be produced.

To achieve the above object, according to the present invention, there is provided a casting mold for producing a fiber-reinforced composite article which comprises a formed product of fiber and a metal matrix by a die-casting process, the mold comprising a cavity which includes a composite article forming area in which the formed product of fiber is located, a molten metal storing area located adjacent the composite article forming area, the molten metal storing area for storing molten metal to fill into the fiber formed-product, and a molten metal flow slackening area for slackening or reducing the turbulent flow of the molten metal from gates as it is introduced into the molten metal storing area.

With the above construction of the mold, even if the gate speed of the molten metal flow is increased to that of the typical die-casting process, the turbulent flow of the molten metal is reduced in the molten metal flow slackening area. As a result, the flow of the molten metal introduced into the molten metal storing area is brought into a substantially laminar flow state, so that the inclusion of air in the molten metal flow is inhibited. Thus, the molten metal in the molten metal storing area is smoothly poured under pressure into the fiber formed-product. This makes it possible to produce a sound fiber-reinforced composite article free of casting defects.

DETAILED DESCRIPTION OF THE PREFERRED EMBODIMENT

Figure 1:
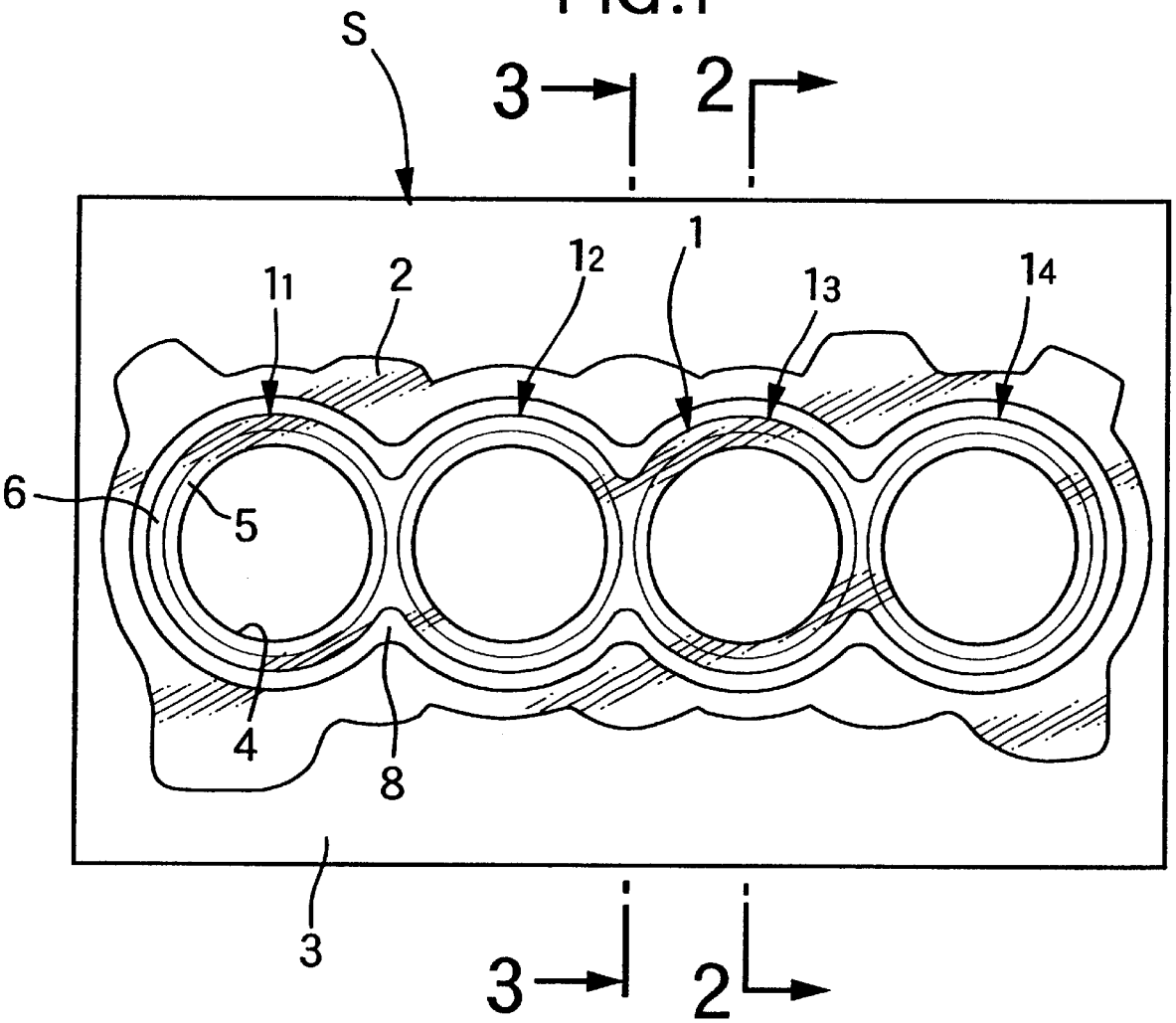
FIG. 1 is a plan view of a cylinder block.
Figure 2:
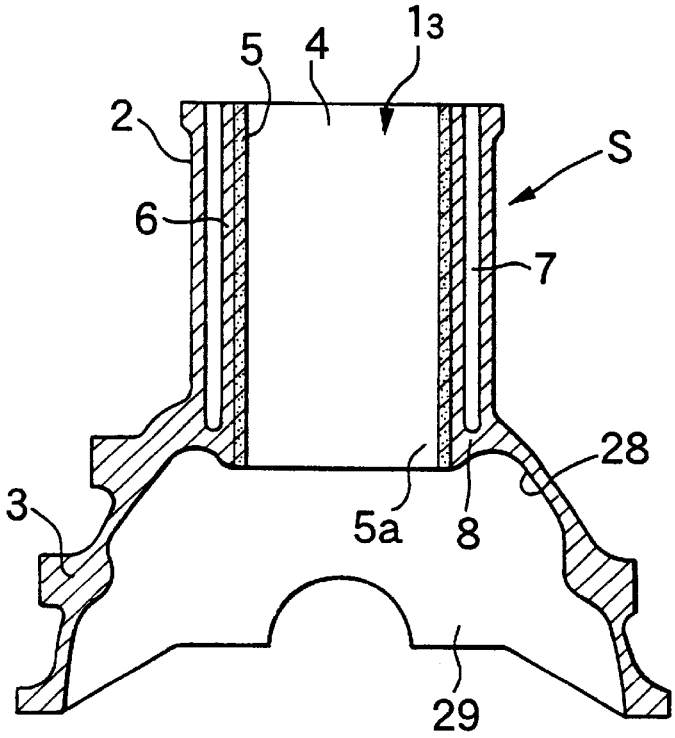
FIG. 2 is a sectional view taken along a line 2—2 in FIG. 1.
Figure 3:
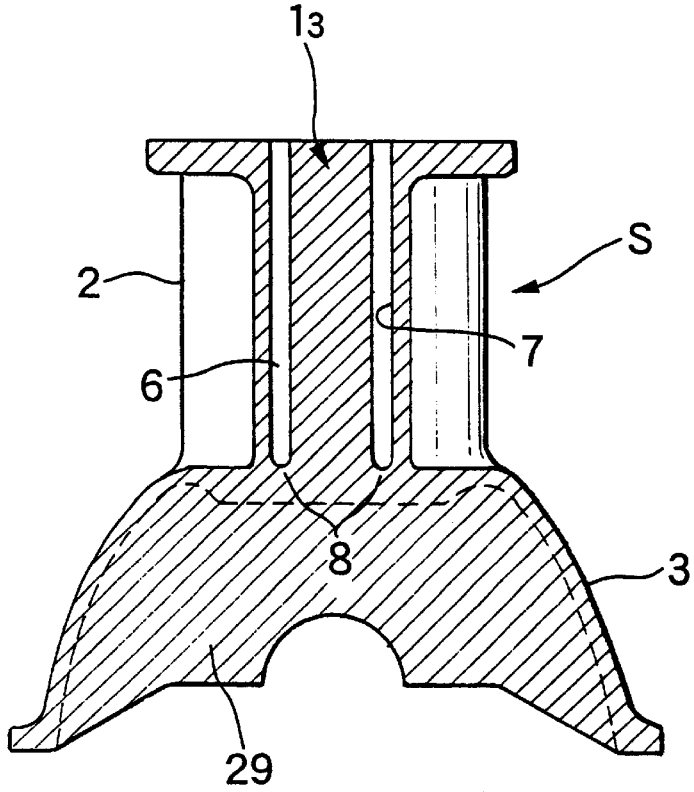
FIG. 3 is a sectional view taken along a line 3—3 in FIG. 1.
Figure 4:
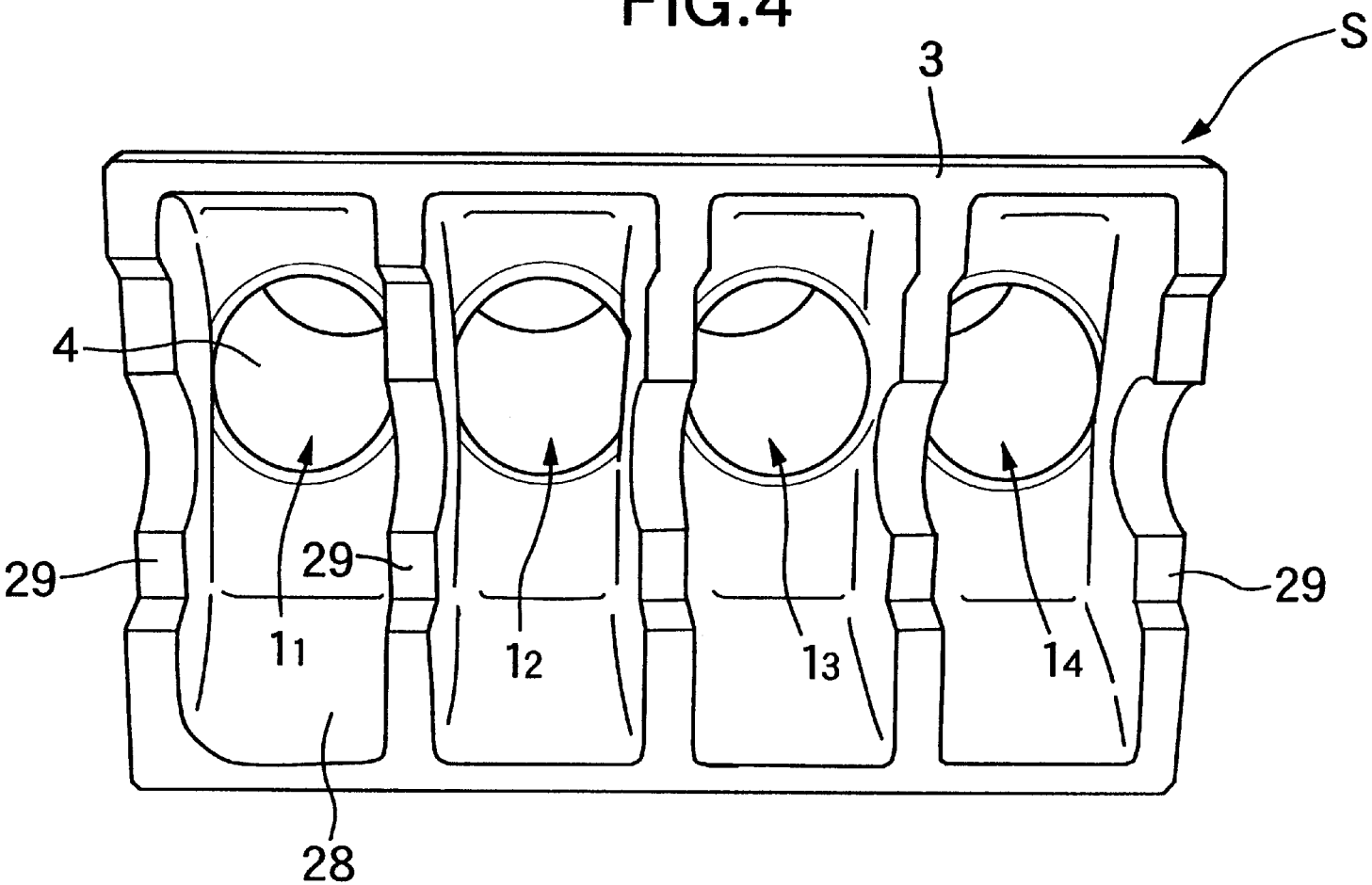
FIG. 4 is a perspective view of the cylinder block as viewed from below.

Referring to FIGS. 1 to 4, a Siamese-type cylinder block S for an engine is comprised of a Siamese-type cylinder barrel section 1 comprised of four cylinder barrels $\mathbf{1}_1$, $\mathbf{1}_2$, $\mathbf{1}_3$ and $\mathbf{1}_4$ coupled to one another in series, an outer wall 2 surrounding the Siamese-type cylinder barrel section 1, and a crankcase 3 connected to a lower edge of the outer wall 2. Each of the cylinder barrels $\mathbf{1}_1$, $\mathbf{1}_2$, $\mathbf{1}_3$ and $\mathbf{1}_4$ is comprised of an inner cylinder section 5 defining a cylinder bore 4, and an outer cylinder section 6 located outside the inner cylinder section 5 and integral with the inner cylinder section 5. A serial space between the Siamese-type cylinder barrel section 1 and the outer wall 2 is a water jacket 7. A lower end of each of the outer cylinder sections 6 and an upper end of the crankcase 3 are connected to each other through a bottom wall 8 of the water jacket 7. The Siamese-type cylinder barrel section 1 and the outer wall 2 are not connected to each other at the opening of the water jacket 7 adjacent a cylinder head and hence, the cylinder block S is an open deck type.

Each of the cylinder barrels $\mathbf{1}_1$, $\mathbf{1}_2$, $\mathbf{1}_3$ and $\mathbf{1}_4$, and the inner cylinder section 5 is a fiber-reinforced composite article which is comprised of a cylindrical fiber formed-product portion and a metal matrix. The outer cylinder section 6 is comprised of only a metal portion forming a matrix. The fiber formed-product portion is formed mainly of an alumina fiber and a carbon fiber which are coupled to each other by a binder. The volume fraction Vf of the fiber formed-product portion is equal to 19%. An aluminum alloy is used as the metal.

Figure 5:
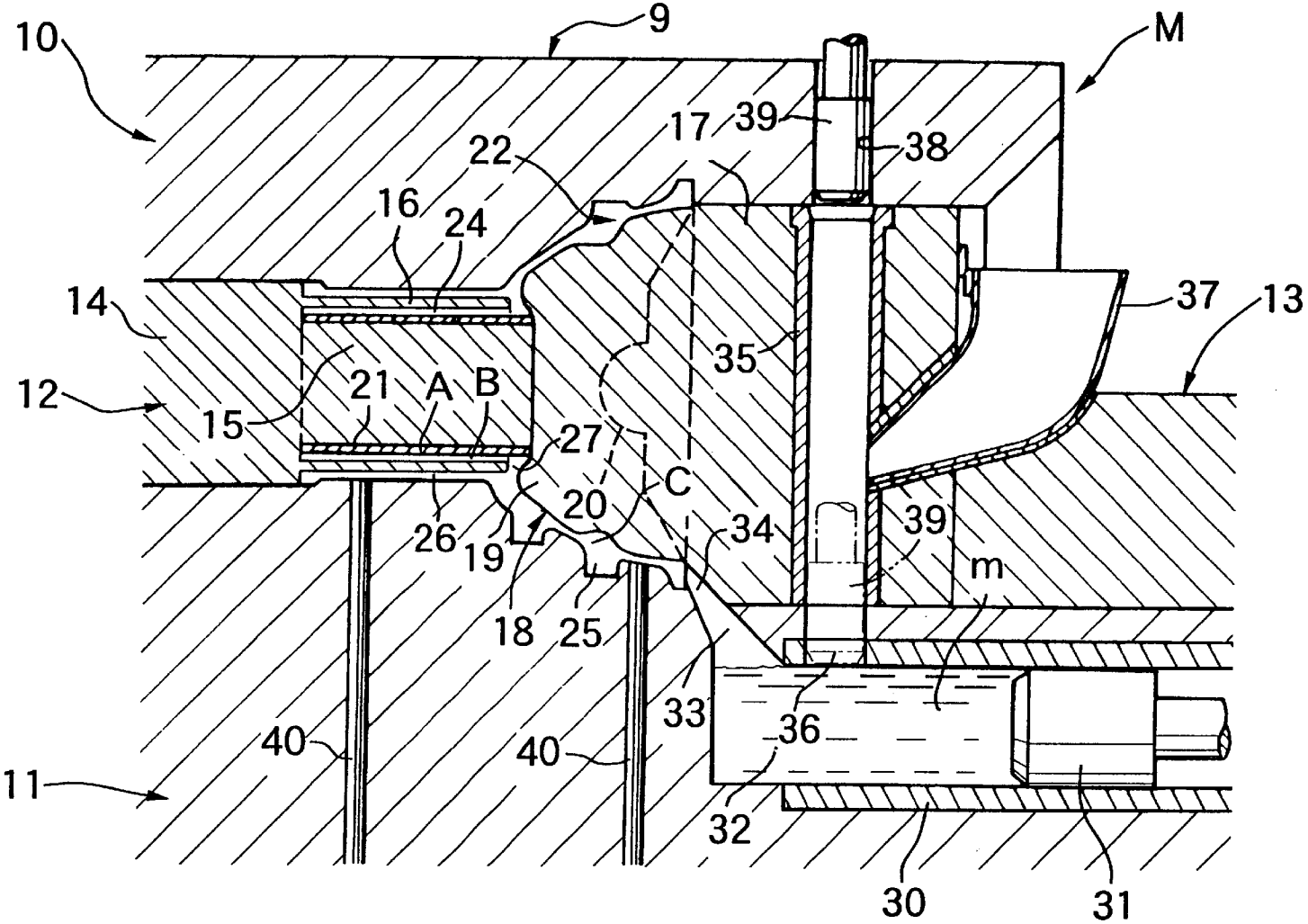
FIG. 5 is a sectional view of the casting apparatus for forming a Siamese-type cylinder block corresponding to FIG. 2.
Figure 6:
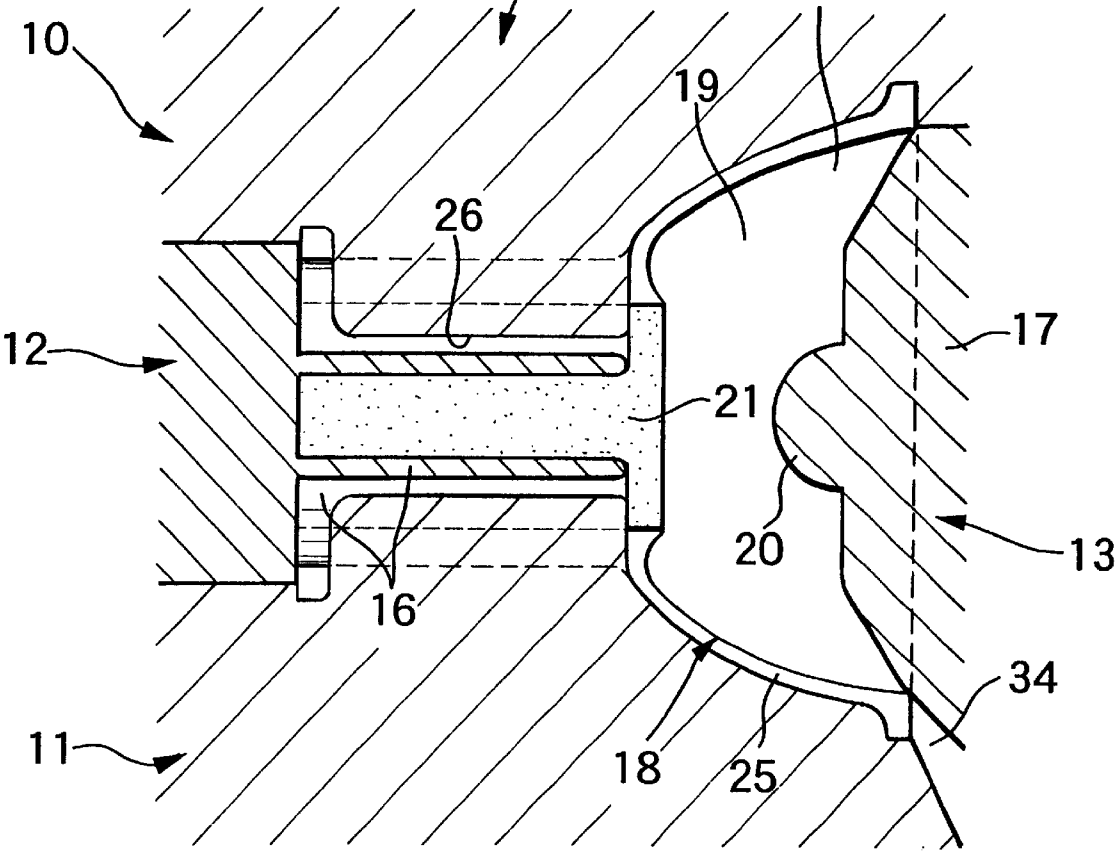
FIG. 6 is a sectional view of the casting apparatus for forming a Siamese-type cylinder block corresponding to FIG. 3.
Figure 7:
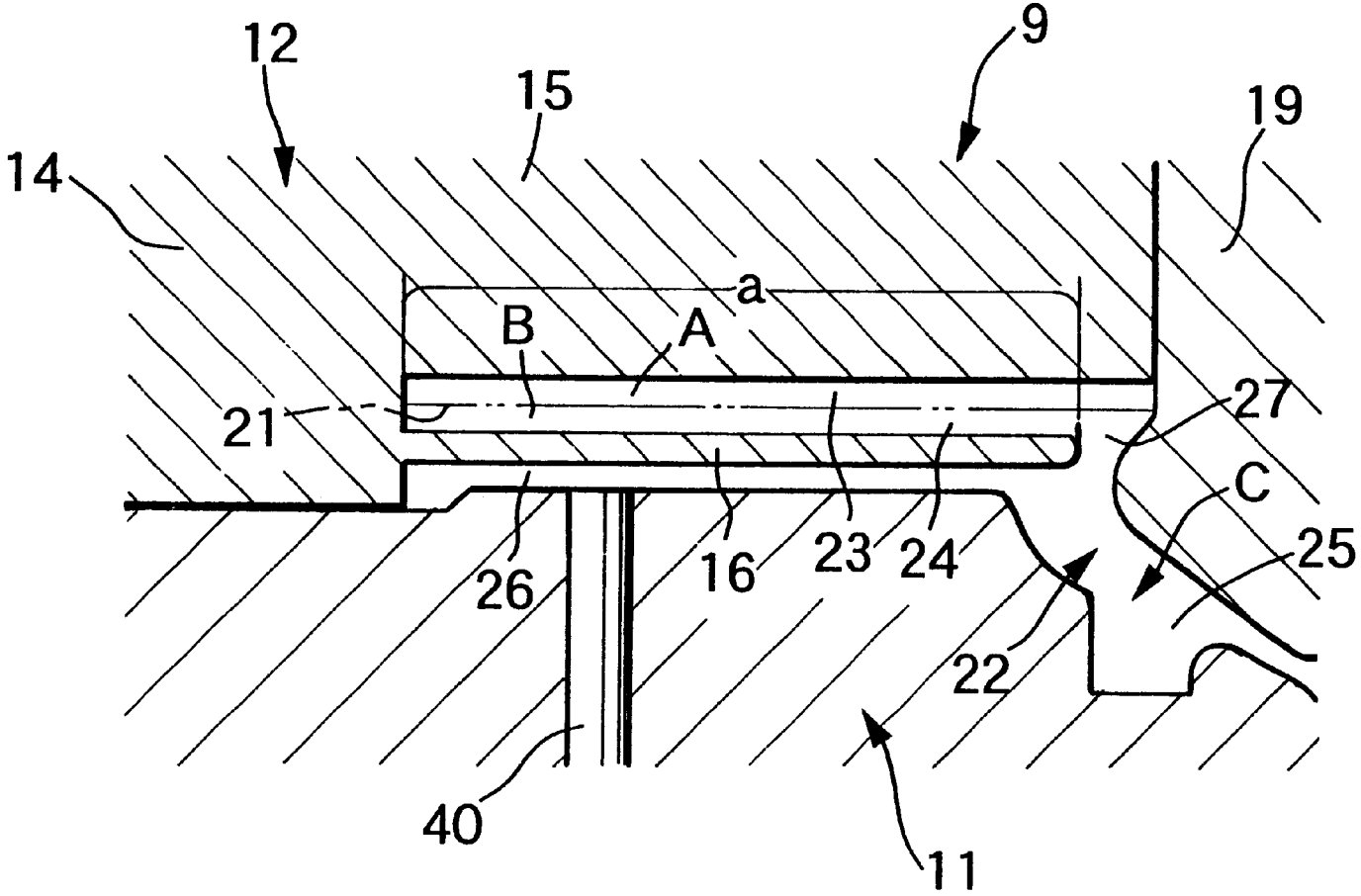
FIG. 7 is an enlarged view of an essential portion shown in FIG. 5.

FIGS. 5 to 7 show a casting apparatus M used for producing the cylinder block S by a die-casting process. A mold 9 in the apparatus M includes an upper die 10 which is liftable and lowerable, a stationary lower die 11 disposed below the upper die 10, and first and second side-dies 12 and 13 which are slidable on the lower die 11.

The first side-die 12 includes a die body 14 which is slidable on the lower die 11. The die body 14 includes, on its surface opposed to the second side-die 13, four cylinder bore-shaping bore pins 15, and a water jacket-shaping core 16 surrounding the bore pins 15. Each of the bore pins 15 has a substantially horizontal axis.

The second side-die 13 includes a die body 17 which is slidable on the lower die 11 and has a forming block 18 on its surface opposed to the first side-die 12. The forming block 18 includes four first semi-cylindrical forming portions 19 each protruding an amount corresponding to each of the cylinder barrels $1_1$, $1_2$, $1_3$ and $1_4$, and projection-like second forming portions 20 located between the adjacent first forming portions 19 and outside the two outer first forming portions 19.

The fiber formed-product 21 is fitted over each of the bore pins 15. In a closed state of the mold, tip end faces of each of the bore pins 15 and each of the fiber formed-product 21 are in abutment against a tip end face of the first forming portions 19.

A cavity 22 is defined by the upper die 10, the lower die 11, the first side-die 12 and the second side-die 13, and has zones which will be described below. As shown in FIG. 7, the cavity 22 has an inner cylinder section-forming zone 23 which is located around each of the bore pins 15 and in which the formed fiber product 21 is placed, an outer cylinder section-forming zone 24 located adjacent each inner cylinder section-forming zone 23, i.e., between each of the formed fiber product 21 and the water jacket-shaping core 16 and around the tip end of the formed fiber product 21 protruding from the core 16. A crankcase-forming zone 25 is located between the first and second molding portions 19 and 20 and the upper and lower dies 10 and 11. An outer wall-forming zone 26 is located between the upper and lower dies 10 and 11 and the water jacket-forming core 16, and a bottom wall-forming zone 27 is provided which permits the crankcase-forming zone 25 to communicate with the outer cylinder section-forming zone 24 and the outer wall-forming zone 26 and which is adapted for forming the bottom wall 8 of the water jacket 16.

A space 28 (FIGS. 2 and 4) for rotation of a crank pin and a crank arm within the crankcase 3 is shaped by the first forming portions 19, and a bearing holder 29 (FIGS. 2 to 4) for a crank journal of the crankcase 3, is shaped by the second forming portions 20.

A first cylinder 30 having a substantially horizontal axis is provided in the lower die 11, and a molten metal supply plunger 31 is slidably received in the first cylinder 30. A molten metal storage portion 32 for the temporary storage of molten metal is defined in front of the tip end of the molten metal supply plunger 31. The molten metal storage portion 32 communicates with a lower portion of the crankcase-forming zone 25 through a single runner 33 extending in the direction of the cylinder barrels, and a plurality of gates 34.

A second cylinder 35 having a substantially vertical axis is provided in the die body 17 of the second side-die 13 and leads to the molten metal storage portion 32 through a through-bore 36. A molten metal supply pipe 37 is provided in the die body 17 to lead to an intermediate portion of the second cylinder 35.

Further, a through-bore 38 is defined in the upper die 10, so that its axis is matched with the axis of the second cylinder 35. The through-bore 38 leads to the second cylinder 35. A seal plunger 39 is slidably received in the through-bore 38.

A plurality of ejector pins 40 are slidably received in the lower die 11 and each protrudes into the outer wall-forming zone 26 and the crankcase-forming zone 25 for releasing the formed cylinder block S from the mold.

In the inner cylinder section-forming zone 23, an area falling into the range a of the length of the water jacket forming core 16 is a substantial composite product forming area A. This is because a portion 5*a* of the inner cylinder section 5 protruding from the water jacket 7 is not in a sliding relation to a piston and hence, need not be a composite article. Therefore, that area in the outer cylinder section forming zone 26 which falls into the range a of the length of the water jacket-forming core 16 is a molten metal storing area B adjacent the composite product forming area A. Further, the crankcase forming zone 25 (including a portion for forming each of the bearing holders 29) and the bottom wall-forming zone 27 of the water jacket 7 form a molten metal flow slackening area C.

Here, if the sum of the volumes of four molten metal storing areas B in the embodiment is represented by $V_1$, and the volume of the molten metal flow slackening area C is represented by $V_2$, both of the volumes $V_1$, and $V_2$ are set in a relationship of $V_2 \geqq 2V_1$. In the embodiment, $V_1:V_2=1:3.37$. If the volume of one molten metal storing area B is represented by V, $V_1=4V$ and thus, $V_2 \geqq 8V$. In the embodiment, $V:V_2=1:13.48$.

In producing a cylinder block S by the die-casting process, a molten metal m of an aluminum alloy is supplied from a melting furnace to the molten metal supply pipe 37; passed through the second cylinder 35 and temporarily accumulated in the molten metal storing portion 32. Then, the seal plunger 39 is lowered to close the through-bore 36 as shown by a dashed line in FIG.5. Thereafter, the molten metal supply plunger 31 is advanced to input the molten metal m under pressure, into the cavity 22 through the runner 33 and the gates 34, thereby producing a cylinder block S in a casting manner. The gate speed of the molten metal flow is in the range of about 30 to about 45 m/sec., preferably in the range of about 32 to about 42 m/sec., and in this preferred embodiment, the gate speed of the molten metal flow is set at 41.3 m/sec.

If the mold 9 is constructed as described above, even if the gate speed of the molten metal flow is increased to as high as 41.3 m/sec., as in a typical die-casting process, the turbulent flow of the molten metal is slackened in the molten metal flow slackening area C and as a result, the flow of the molten metal introduced into each of the molten metal storing areas B is brought into a laminar flow state, so that the inclusion of air in the flow of the molten metal is inhibited. Thus, the molten metal in each of the molten metal storing areas B is filled smoothly into the formed fiber product 21. This makes it possible to produce a sound inner cylinder section 5 free of casting defects.

The present invention may also be applied to a case where the sliding portion of an oil pump is formed from a fiber-reinforced composite article in a member other than the cylinder block, e.g., a control body of an automatic transmission.

According to the present invention, it is possible to provide a mold which is capable of producing a sound fiber-reinforced composite article even if the gate speed of the molten metal flow is increased as in ordinary die-casting processes. Thus, it is possible to reduce the equipment cost and to enhance the efficiency of production of the fiber-reinforced composite article.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A casting mold for producing a fiber-reinforced composite article comprised of a formed product of fiber and a metal matrix using a die-casting process is employed, said mold comprising a cavity having a composite article forming area, for positioning the formed product of fiber therein; a molten metal storing area located adjacent said composite article forming area for storing molten metal to be filled into a fiber formed-product; and a molten metal flow slackening area located between a gate sized and adapted to introduce the molten metal at a gate speed of about 30 m/sec. to about 45 m/sec. and said molten metal storing area for reducing a turbulent flow of the molten metal introduced from the gate into said molten metal storing area for reducing a turbulent flow of the molten metal introduced from the gate into said molten metal storing area, wherein when the volume of said molten metal storing area is represented by V, and the volume of said molten metal flow slackening area is represented by $V_2$, the volume V and $V_2$ are in a relationship of $V_2 \geqq 8V$.

2. A casting mold for producing a fiber-reinforced composite article according to claim 1 wherein as said gate there are provided a plurality of gates.

3. A casting mold for producing a fiber-reinforced composite article according to claim 1, wherein the gate is sized and adapted to introduce the molten metal into the mold at a gate speed of about 32 m/sec to about 42 m/sec.

4. A casting mold for producing a fiber-reinforced composite article according to claim 3, wherein the gate is sized and adapted to introduce the molten metal into the mold at a gate speed of about 41.3 m/sec.

* * * * *